US009238562B2

(12) United States Patent
Mori et al.

(10) Patent No.: US 9,238,562 B2
(45) Date of Patent: Jan. 19, 2016

(54) IMAGE FORMING APPARATUS

(71) Applicant: Brother Kogyo Kabushiki Kaisha, Nagoya (JP)

(72) Inventors: Tatsuaki Mori, Kuwana (JP); Tomoya Yamamoto, Nagoya (JP); Ryosuke Sakai, Nagoya (JP); Atsushi Hayakawa, Okazaki (JP); Takuya Yamaguchi, Toyokawa (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/666,840

(22) Filed: Mar. 24, 2015

(65) Prior Publication Data

US 2015/0274469 A1 Oct. 1, 2015

(30) Foreign Application Priority Data

Mar. 31, 2014 (JP) ..... 2014-070765
Sep. 30, 2014 (JP) ..... 2014-201824

(51) Int. Cl.

| | |
|---|---|
| ***B65H 15/00*** | (2006.01) |
| ***B65H 29/58*** | (2006.01) |
| ***B65H 31/24*** | (2006.01) |
| ***B65H 43/00*** | (2006.01) |
| ***B65H 29/60*** | (2006.01) |

(52) U.S. Cl.

CPC ..... *B65H 15/00* (2013.01); *B65H 29/58* (2013.01); *B65H 29/60* (2013.01); *B65H 31/24* (2013.01); *B65H 43/00* (2013.01); *B65H 2301/333* (2013.01)

(58) Field of Classification Search

CPC ..... B65H 15/00; B65H 29/60; B65H 31/22; B65H 31/24; B65H 2301/33; B65H 2301/3331; B65H 2301/33312

See application file for complete search history.

(56) References Cited

U.S. PATENT DOCUMENTS

| | | | | |
|---|---|---|---|---|
| 5,810,353 | A * | 9/1998 | Baskette et al. | 271/305 |
| 6,308,952 | B1 * | 10/2001 | Takagi et al. | 271/297 |
| 7,976,021 | B2 * | 7/2011 | Matsuo | 271/305 |
| 2003/0063935 | A1 | 4/2003 | Seo | |
| 2006/0140696 | A1 * | 6/2006 | Uehara | B65H 29/12 399/406 |
| 2014/0339764 | A1 * | 11/2014 | Suzuki et al. | 271/302 |

FOREIGN PATENT DOCUMENTS

| | | | |
|---|---|---|---|
| JP | 2001-117291 | A | 4/2001 |
| JP | 2003-076090 | A | 3/2003 |
| JP | 2003-118914 | A | 4/2003 |
| JP | 2009-075478 | A | 4/2009 |
| JP | 2012-220870 | A | 11/2012 |
| JP | 2014-051350 | A | 3/2014 |

* cited by examiner

*Primary Examiner* — Jeremy R Severson
(74) *Attorney, Agent, or Firm* — Burr & Brown, PLLC

(57) ABSTRACT

An image forming apparatus, including a main body with a first sheet outlet tray and an image forming unit, a feed path configured to guide a sheet from the image forming unit toward the first sheet outlet tray, is provided. The feed path includes a first exit path to guide a sheet toward the first sheet outlet tray and a first duplex path diverging from the feed path to guide a sheet to return to the image forming unit. The main body is attachable with a sheet-exit unit. The sheet-exit unit includes a second sheet outlet tray, a second exit path, and a second duplex path. The second exit path guides a sheet to the second sheet outlet tray. The second exit path is connected with the first exit path when the sheet-exit unit is attached to the main body.

7 Claims, 13 Drawing Sheets

IMAGE FORMING APPARATUS

CROSS REFERENCE TO RELATED APPLICATION

This application claims priority from Japanese Patent Application No. 2014-070765 filed on Mar. 31, 2014, and No. 2014-201824 filed on Sep. 30, 2014, the entire subject matters of which are incorporated herein by reference.

BACKGROUND

1. Technical Field

An aspect of the present invention relates to an image forming apparatus capable of forming images on both sides of a sheet.

2. Related Art

An image forming apparatus capable of forming images on both sides of a sheet is known. The image forming apparatus may have a sheet-exit path, through which the sheet conveyed out of an image forming unit is ejected to an outlet tray, and a duplex path, which diverges from the sheet-exit path and in which the sheet conveyed out of the image forming apparatus is guided to return to the image forming apparatus. When images are to be formed on both sides of the sheet in the image forming apparatus, first, an image may be formed on one side of the sheet, and the sheet may be conveyed for a predetermined distance toward the outlet tray by an exit roller, which is disposed on the sheet-exit path. Thereafter, rotation of the exit roller may be reversed so that the sheet may be guided back through the duplex path.

SUMMARY

According to the above configuration, however, when the sheet is guided to the duplex path, the ejection roller may be occupied by the returning sheet. Therefore, a succeeding sheet may not be ejected while the preceding returning sheet is in the duplex path. Accordingly, when the images are formed on both sides of the preceding sheet, and the succeeding sheet follows the preceding sheet, it may be necessary that these sheets are conveyed intermittently, and a longer interval may be required until completion of forming the images on these successive sheets.

According to an aspect of the present invention, an image forming apparatus, including a main body having a first sheet outlet tray and an image forming unit; and a feed path configured to guide a sheet from the image forming unit toward the sheet outlet tray, is provided. The feed path includes a first exit path configured to guide a sheet toward the first sheet outlet tray; and a first duplex path configured to diverge from the feed path and guide a sheet to return to the image forming unit. The main body is configured to be attachable with a sheet-exit unit, the sheet-exit unit comprising a second sheet outlet tray, a second exit path, and a second duplex path, the second exit path being configured to guide a sheet to the second sheet outlet tray. The second exit path is connected with the first exit path and the second duplex path is connected with the first duplex path when the sheet-exit unit is attached to the main body.

According to the present invention, a sheet exit unit configured to be attachable with a main body of an image forming apparatus, which includes a first sheet outlet tray, a first exit path, and a first duplex path, is provided. The sheet exit unit includes a body comprising a second sheet outlet tray; a second exit path configured to guide a sheet to the second sheet outlet tray; and a second duplex path configured to guide a sheet. The second exit path is connected with the first exit path and the second duplex path is connected with the first duplex path when the sheet exit unit is attached to the main body.

BRIEF DESCRIPTION OF THE ACCOMPANYING DRAWINGS

DETAILED DESCRIPTION

Figure 1:
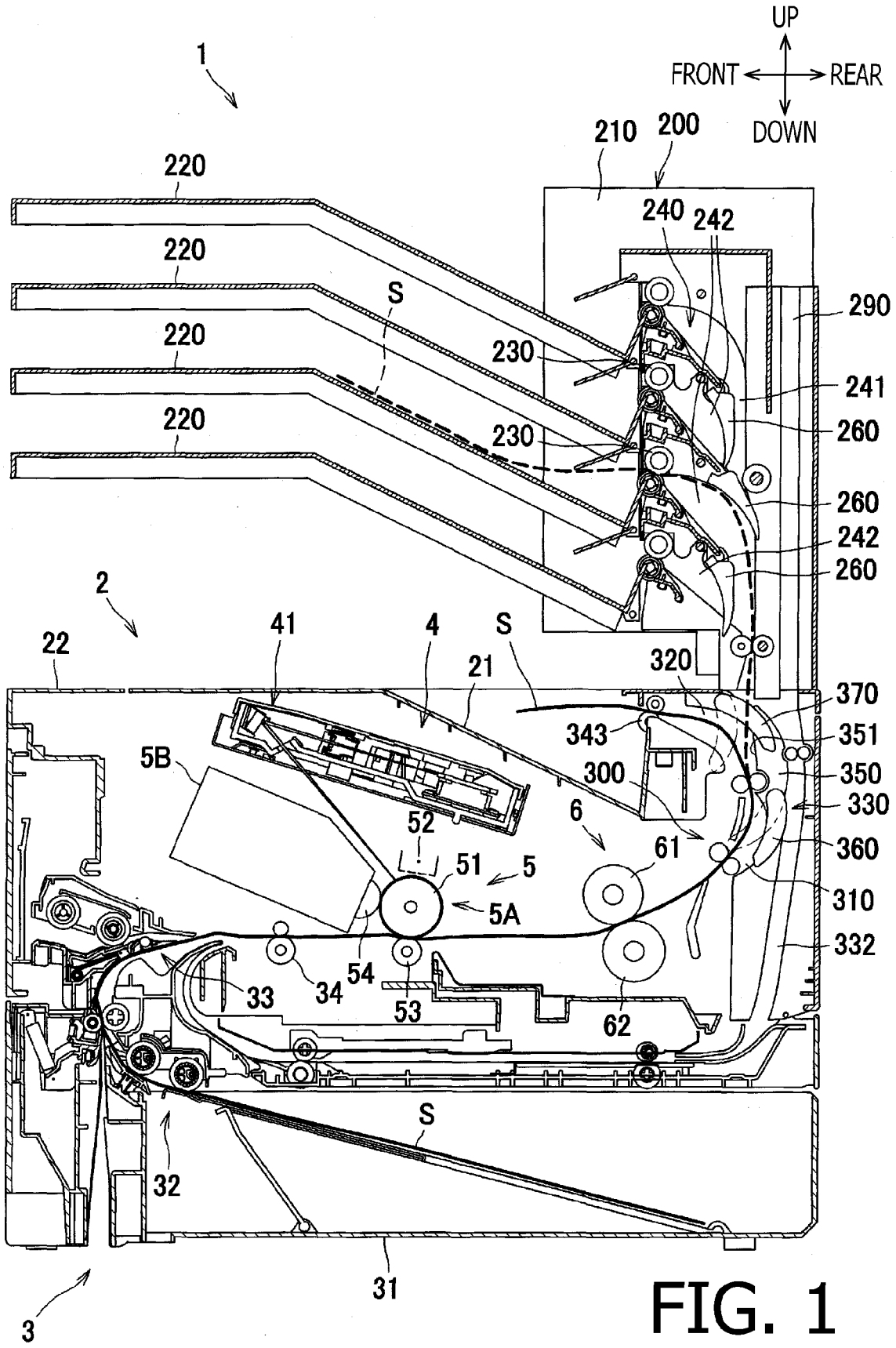
FIG. 1 is an illustrative cross-sectional side view of a laser printer with a sheet-exit unit according to a first exemplary embodiment of the present invention.

Hereinafter, an exemplary configuration of a laser printer 1 according to a first embodiment of the present invention will be described with reference to the accompanying drawings. In the following description, directions concerning the laser printer 1 will be referred to in accordance with a user's ordinary position to use the laser printer 1, as indicated by arrows in each drawing. For example, a viewer's left-hand side appearing in FIG. 1 is referred to as a front side of the laser printer 1, and a right-hand side in FIG. 1 opposite from the front side is referred to as a rear side. A side which corresponds to the viewer's nearer side is referred to as a right-hand side for the user, and an opposite side from the right, which corresponds to the viewer's farther side is referred to as a left-hand side for the user. An up-down direction in FIG. 1 corresponds to a vertical direction of the laser printer 1. Further, the right-to-left or left-to-right direction of the laser printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-5 are similarly based on the orientation of the laser printer 1 as defined above and correspond to those with respect to the laser printer 1 shown in FIG. 1 even when the drawings are viewed from different angles.

The laser printer 1 is capable of forming images on either side or both sides of a sheet S. The laser printer 1 includes a main body 2 and is attachable with a sheet-exit unit 200, which is an optional device to be used with the main body 2 of the laser printer 1. The sheet-exit unit 200 is attachable to a top part of the main body 2 when used in the laser printer 1.

The main body 2 includes a feeder unit 3, an image forming unit 4, and a conveyer unit 300, which are arranged therein. The main body 2 further includes a main outlet tray 21, on which the sheet S with the image formed thereon is placed to be ejected, in an upper part thereof. The main outlet tray 21 is disposed in an upper position with respect to the image forming unit 4.

The feeder unit 3 feeds sheets S to the image forming unit 4. The feeder unit 3 includes a sheet cassette 31 to store the sheets S, a feeder device 32 including rollers to convey the sheets S, a feeder path 33, in which the sheets S picked up from the sheet cassette 31 are guided to the image forming unit 4, and a pair of registration rollers 34.

The sheets S stored in the sheet cassette 31 are separated by the feeder device 32 from one another and conveyed to the feeder path 33 one-by-one to pass through the paired registration rollers 34 and to be conveyed to the image forming unit 4. The paired registration rollers 34 are disposed in a position in the vicinity of an outlet of the feeder path 33. When a leading edge of the sheet S contacts the paired registration rollers 34 before the sheet S reaches the image forming unit 4, the sheet S is stopped momentarily so that an orientation of the sheet S is corrected from skewing, and timing for forming the image on the sheet S being fed is adjusted.

The image forming unit 4 may serve to form the image on the sheet S being fed and is disposed in an upper position with respect to the sheet cassette 31. The image forming unit 4 includes a scanner unit 41, a processing cartridge 5, and a fixing unit 6.

The scanner unit 41 is disposed in an upper position in the main body 2. In the scanner unit 4, a laser beam is emitted and transmitted to a surface of a photosensitive drum 51 in the processing cartridge 5 via polygon mirrors, lenses, and reflection mirrors, which are unsigned, to scan the surface of the photosensitive drum 51.

The processing cartridge 5 is detachably attached to the main body 2 through an opening (unsigned), which is exposed or covered by a front cover 22, while the front cover 22 is pivotable on a front side of the main body 2. The processing cartridge 5 includes a drum unit 5A and a developer cartridge 5B. The developer cartridge 5B is removably attached to the drum unit 5A.

The drum unit 5A includes a photosensitive drum 51, on which an electrostatic latent image is formed, a charger 52, and a transfer roller 53.

The developer cartridge 5B contains a toner therein and includes a developer roller 54, which supplies the toner to the photosensitive drum 51, and a supplier roller, a toner-spreader blade, and an agitator, which are not shown.

In the processing cartridge 5, as the photosensitive drum 51 rotates, a surface of the photosensitive drum 51 is electrically charged by the charger 52 evenly and partly exposed to the laser beam emitted from the scanner unit 41 so that electrical charges of the exposed areas are lowered and a latent image according to image data is formed to be carried on the surface of the photosensitive drum 51.

Meanwhile, the toner in the developer cartridge 5B is supplied to the latent image on the photosensitive drum 51 through the developer roller 54 while the developer roller 54 is rotated so that the latent image on the photosensitive drum 51 is developed to be a toner image. In the meantime, as the sheet S is conveyed through a position between the photosensitive drum 51 and the transfer roller 53, the toner image carried on the surface of the photosensitive drum 51 is transferred onto the sheet S.

The fixing unit 6 is disposed in a rearward position with respect to the processing cartridge 5 and includes a heat roller 61 with a heater (not shown) and a pressure roller 62, which nips the sheet S in a position between the heat roller 61 and the pressure roller 62. In the fixing unit 6, the toner image transferred to the sheet S is thermally fixed thereon as the sheet S passes through the position between the heat roller 61 and the pressure roller 62.

The conveyer unit 300 may serve to guide the sheet S having been conveyed through the image forming unit 4 to the main outlet tray 21 or to the sheet-exit unit 200. Further, the conveyer unit 300 may serve to guide the sheet S having been conveyed through the image forming unit 4 to return to the image forming unit 4. Detailed configuration of the conveyer unit 300 will be described later.

The sheet-exit unit 200 includes a plurality of optional trays 220, which are arranged to align vertically. The sheets S conveyed through the main body 2 may be sorted to one or more of the optional trays 220.

The sheet-exit unit 200 further includes a chassis 210 to support the plurality of optional trays 220, outlet rollers 230, each of which is arranged to correspond to each of the optional trays 220 respectively, and outlet path 240, through which the sheets S conveyed out of the main body 2 are further guided to the optional trays 220.

The outlet path 240 includes a first outlet path 241 and a second outlet path 242. The first outlet path 241 extends to an uppermost one of the optional trays 220. The second outlet path 242 includes a plurality of outlet paths 242, which diverge from the first outlet path 241 to extend to the optional trays 220 other than the uppermost optional tray 220. In a position where each second outlet path 242 diverges from the first outlet path 241, disposed is a switching member 260, which is swingable to switch directions to convey the sheets S.

Figure 2:
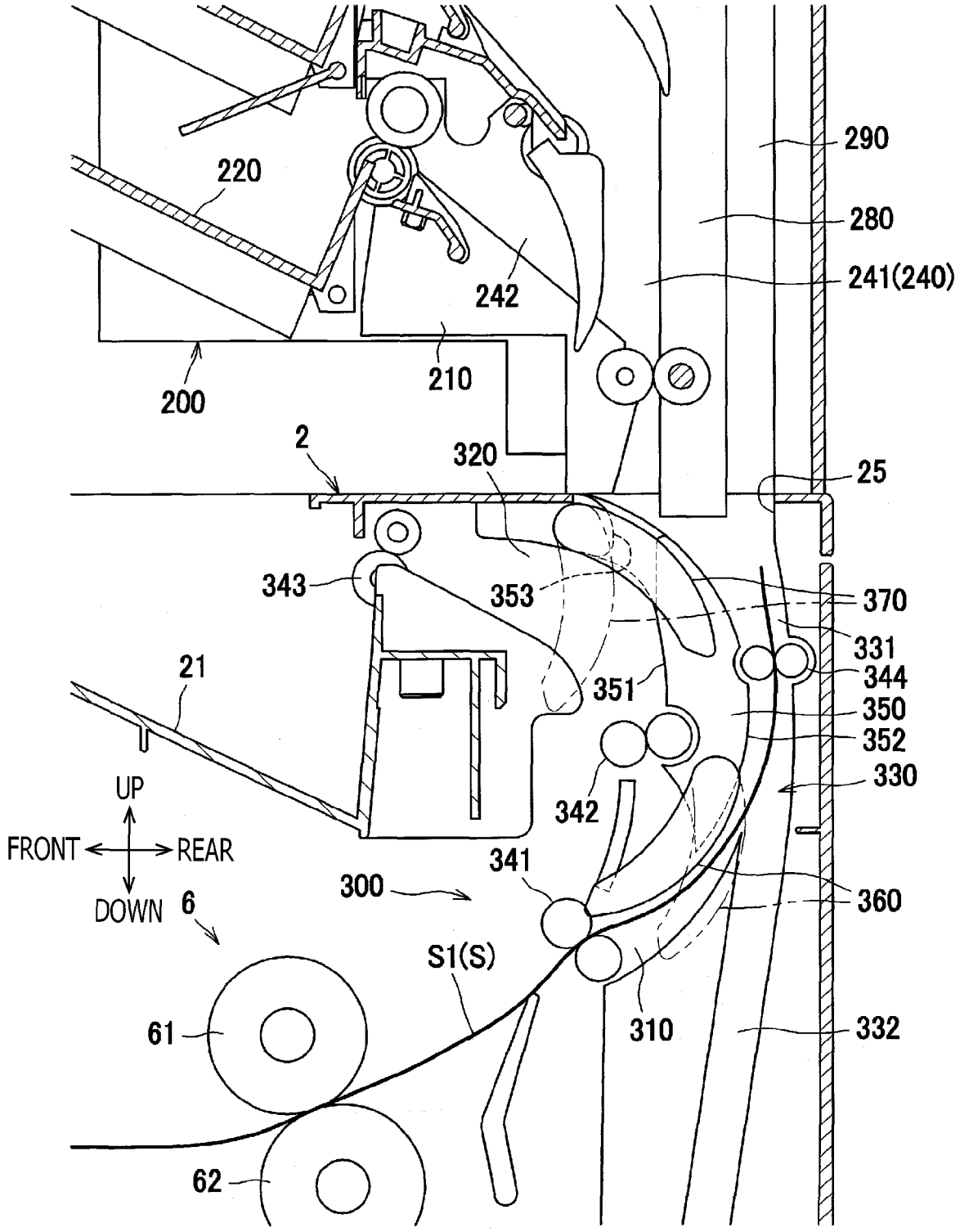
FIG. 2 is a partially enlarged view of a conveyer unit in the laser printer, when a sheet is conveyed to a duplex path, according to the first exemplary embodiment of the present invention.

Next, a configuration of the conveyer unit 300 will be described below. As shown in FIG. 2, the conveyer unit 300 includes an in-body feed path 310, in which the sheets S having been conveyed through the fixing unit 6 is guided, a first exit path 320, which diverges from the in-body feed path 310 to guide the sheets S to the main outlet tray 21, and an in-body duplex path 330, which diverges from the in-body feed path 310 to guide the sheets S to return to the image forming unit 4. The conveyer unit 300 includes a guide 350 which guides the sheets S to be conveyed there-along, and a first flapper 360 and a second flapper 370 which switch directions to convey the sheets S.

The in-body feed path 310 extends up-rearward from a rearward position with respect to the fixing unit 6. Along the in-body feed path 310, disposed is a first conveyer roller 341.

The first exit path 320 extends upper-frontward from an upper end of the in-body feed path 310. Therefore, a feed path, which includes the in-body feed path 310 and the first exit path 320, extends to be away from the fixing unit 6 and turns in a shape of a "U" toward the main outlet tray 21. Along the first exit path 320, disposed are a second conveyer roller 342 and a main exit roller 343.

The second conveyer roller 342 conveys the sheets S having been conveyed through the in-body feed path 310 to the first exit path 320 and is disposed along a curved end, i.e., a bottom part, of the "U" formed by the in-body feed path 310 and the first exit path 320.

The main exit roller 343 is disposed at an outlet of the first exit path 320 to eject the sheets S to the main outlet tray 21.

The in-body duplex path 330 includes a first path 331 and a second path 332. The first path 331 extends from the in-body feed path 310 upward through a rear side of the first exit path 320 and provides a passage to the outside of the main body 2. The second path 332 diverges from the first path 331 and extends downward toward the image forming unit 4.

Meanwhile, the main body 2 has an opening 25, which is capable of allowing the sheets S to pass there-through, in a rearward position on a top surface thereof. The opening 25 is formed to range between a position where the first exit path 320 overlaps, in a vertical view, and a rearward position with respect to the first exit path 320. The first path 331 of the in-body duplex path 330 is continuous with the opening 25 at an upper end thereof.

Along the first path 331, disposed is a third conveyer roller 344. The third conveyer roller 344 is rotatable in either a normal direction or a reverse direction. The third conveyer roller 344 being rotated in the normal direction may convey the sheets S outward through the opening 25 outside the main body 2, and the third conveyer roller 344 being rotated in the reverse direction may convey the sheets S inward to draw inside the main body 2.

The second path 332 extends from the first path 331 downward and, as shown in FIG. 1, curves frontward to further extend between the image forming unit 4 and the sheet cassette 31. Further, the second path 332 curves to extend upward at a lower position with respect to the paired registration rollers 34 and merges with the feeder path 33 at a frontward position with respect to the paired registration rollers 34.

Referring back to FIG. 2, the guide 350 forms a part of the feed path, which includes the first exit path 320 and the in-body duplex path 330. The guide 350 is arranged in a position outside the U-shape of the feed path, in a position between the first exit path 320 and the first path 331 of the in-body duplex path 330. The guide 350 extends from an upper rearward position with respect to the first conveyer roller 341 to curve upward and frontward to be continuous with a front edge of the opening 25.

A first face 351 being a front surface of the guide 350 is arranged on an outer side of the U-shape of the feed path, which includes the in-body feed path 310 and the first exit path 320, i.e., a rear side of the sheet S (see FIG. 1) being guided in the first exit path 320. Thus, the guide 350 forms a part of the first exit path 320 at the outer side of the U-shape of the feed path and guides the sheets S to be conveyed in the first exit path 320.

The guide 350 is formed to have a communication slot 353, which is bored vertically through the guide 350, at a position downstream, with regard to a direction to feed the sheets S, from the bottom part of the U-shape in the feed path including the in-body feed path 310 and the first feed path 320. The communication slot 353 is formed in a substantial size for the sheets S to pass there-through. Through the communication slot 353, the first exit path 320 is continuous with the opening 25.

The first flapper 360 is swingably attached to the main body 2 and switches the directions to convey the sheets S at a diverging point, where the in-body duplex path 330, more specifically, the first path 331, diverges from the in-body feed path 310. When the sheets S having been conveyed through the fixing unit 6 are to be guided to the first exit path 320, the first flapper 360 is placed in an outlet position, in which the in-body duplex path 330 is closed, as indicated by double-dotted lines in FIG. 2. When the sheets S having been conveyed through the fixing unit 6 are to be guided to the in-body duplex path 330, the first flapper 360 is moved to swing frontward from the outlet position to a returning position, in which the in-body duplex path 330 is opened, and the first exit path 320 is closed, as indicated by solid lines in FIG. 2.

The second flapper 370 is movable to open or close the communication slot 353 to switch the directions to convey the sheets S in the first exit path 320. The second flapper 370 is swingable with respect to the main body 2 with an upper end thereof being swingably attached to a frontward position with respect to the communication slot 353 so that a lower end of the flapper 370 may swing frontward and rearward. The second flapper 370 is swingable between a first position, in which the communication slot 353 is closed and the sheets S being conveyed in the first exit path 320 are guided toward the main outlet tray 21, as indicated by solid lines in FIG. 2, and a second position, in which the communication slot 353 is opened to guide the sheets S being conveyed in the first exit path 320 to the communication slot 353, as indicated by double-dotted lines in FIG. 2.

The flapper 370 is, when in the first position, arranged to locate a surface thereof facing with the first path 331 to substantially align with a second face 352 of the guide 350. Thus, the second flapper 370 forms a part of the first path 331 when in the first position.

Along with the conveyer unit 300 configured as above, when the sheet-exit unit 200 is attached to the main body 2, the outlet path 240 is continuous with the first exit path 320 through the communication slot 353. In other words, with the sheet-exit unit 200 being attached to the main body 2, the outlet path 240 is connected with the first exit path 320 at a downstream part from the bottom of the U-shape in the feed path, which includes the in-body feed path 310 and the first exit path 320, with regard to the direction to feed the sheets S.

Meanwhile, the sheet-exit unit 200 includes an exit-unit duplex path 290, which is connected with the first path 331 of the in-body duplex path 330 when the sheet-exit unit 200 is attached to the main body 2. The exit-unit duplex path 290 extends vertically along a vertical part of the first outlet path 241 in the outlet path 240 (see also FIG. 1). While the sheet-exit unit 200 is attached to the main body 2, the exit-unit duplex path 290 is connected with the first path 331 (i.e., a temporary exit path 333, which will be described later), at a rearward position with respect to the communication slot 353, i.e., an upstream position with regard to the direction to feed the sheets S in the first path 331 when the third roller 344 is rotating in the normal direction.

The sheet-exit unit 200 may have a partition 280 stretching vertically in a position between the outlet path 240 and the exit-unit duplex path 290. The partition 280 may guide the sheets S being conveyed in the outlet path 240 on a front side thereof and the sheets S being conveyed in the exit-unit duplex path 290 on a rear side thereof.

The sheet-exit unit 200 is, when attached to the main body 2, arranged to locate a lower end of the partition 280 inside the main body 2 through the opening 25 so that the lower end of the partition 280 faces with the guide 350 at a rearward position with respect to the communication slot 353. Therefore, the sheets S being conveyed through the first exit path 320 and reaching the communication slot 353 are guided to the outlet path 240, and the sheets S being conveyed through the in-body duplex path 330 are guided to the exit-unit duplex path 290.

In this regard, the exit-unit duplex path 290 is formed to have a substantial length such that a length between the diverging point of the in-body duplex path 330 from the in-body feed path 310 and an upper end of the exit-unit duplex path 290 is longer than a length of the first exit path 320 and a length of the temporary exit path 333, which will be described later.

Meanwhile, the laser printer 1 has a cover 400 (see FIG. 4), which is detachably attached to the main body 2 when the sheet-exit unit 200 is not attached to the main body 2. The cover 400, when attached to the main body 2, covers the opening 25 from above. Further, when attached to the main body 2, the cover 400 guides the sheets S being ejected outward through the opening 25.

The cover 400 includes a guide surface 410, which stretches upward from a position in a vicinity of a rear edge of the opening 25, when attached to the main body 2. The guide surface 410 stretches frontward over the opening 25 to a frontward position with respect to the opening 25. The guide surface 410 and an upper wall 26 of the main body 2 forms an in-cover path 420.

When the sheet-exit unit 200 is removed from the main body 2, and the cover 400 is attached to the main body 2, the temporary exit path 333 is provided. The temporary exit path 333 includes the first path 331 and the in-cover path 420 and forms a part of the in-body duplex path 330. The temporary exit path 333 extends along the first exit path 320, on an outer side of the first exit path 320. The temporary exit path 333 is formed in a shape of U, which extends outward from the in-body feed path 310 to the outer side of the U-shape, formed with the in-body feed path 310 and the first exit path 320, and turns frontward, i.e., toward the main outlet tray 21.

Next, behaviors of the laser printer 1 will be described below. When an image is formed in the image forming unit 4 and the sheet S with the formed image is guided to the main outlet tray 21, as shown in FIG. 1, the first flapper 360 is moved to swing rearward to the outlet position, and the second flapper 370 is moved to swing rearward to the first position. Thereby, the first exit path 320 is opened, and the in-body duplex path 330 and the communication slot 353 are closed. With the first exit path 320 being open, and the in-body duplex path 330 and the communication slot 353 being closed, the sheet S having been conveyed through the image forming unit 4 is guided through the in-body feed path 310 to the first exit path 320 and is ejected out of the main body 2 by the main exit roller 343 to be placed on the main outlet tray 21.

When the sheet S having been conveyed through the image forming unit 4 is guided to a designated one of the optional trays 220 in the sheet-exit unit 200, the first flapper 360 is moved to swing rearward to the outlet position so that an inlet of the first exit path 320 is opened, and the in-body duplex path 330 is closed. Meanwhile, the second flapper 370 is moved to swing frontward to the second position so that the communication slot 353 is opened, and a downstream part of the first exit path 320 from the communication slot 353 with regard to the direction to feed the sheet S is closed. With the first flapper 360 in the outlet position and the second flapper 370 in the second position, when the sheet S is conveyed through the image forming unit 4, the sheet S is guided in the in-body feed path 310 to the first exit path 320 and to the outlet path 240 in the sheet-exit unit 200 through the communication slot 353.

Meanwhile, switching members 260 are moved to swing in the sheet-exit unit 200 so that the second outlet path 242 continuous with the designated optional tray 220 is opened. Thereby, the sheet S being conveyed through the outlet path 240 is guided to the designated optional tray 220 and ejected by the outlet rollers 230 to the designated optional tray 220.

When double-face printing is to be performed to form images on each side of a plurality of sheet S1, S2, while the sheet-exit unit 200 is attached to the main body 2, as shown in FIG. 2, the first flapper 360 is moved to swing frontward to the returning position. Thus, the first exit path 320 is closed, and the in-body duplex path 330 is opened. A first sheet S1 with an image formed on a first side thereof is conveyed through the image forming unit 4 to the in-body feed path 310 and to the first path 331 of the in-body duplex path 330. Thereafter, the first sheet S1 in the first path 331 is conveyed by the third conveyer roller 344 rotating in the normal direction through the opening 25 to the exit-unit duplex path 290.

Figure 3:
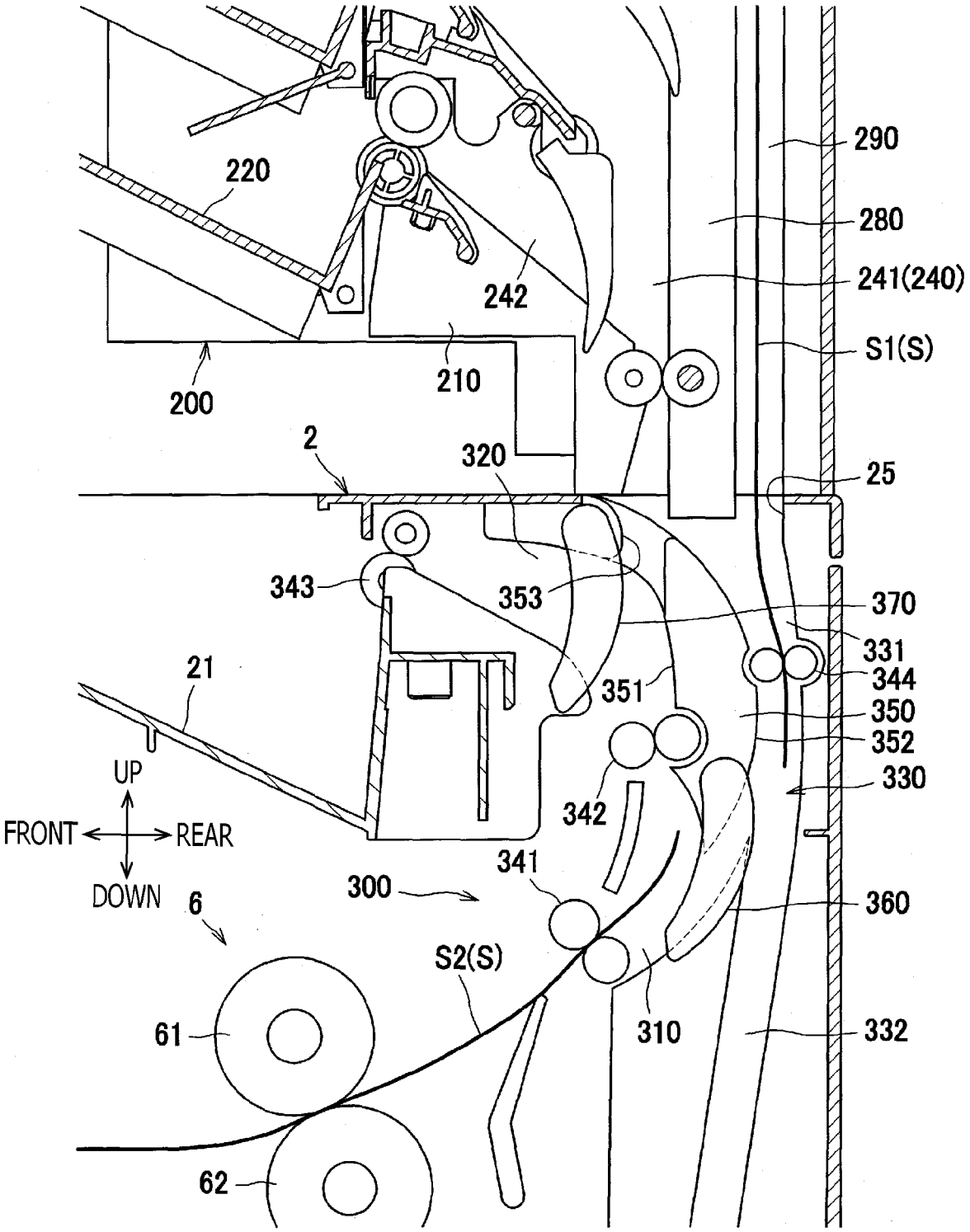
FIG. 3 is a partially enlarged view of the conveyer unit in the laser printer, when a succeeding sheet is conveyed to a first exit path, according to the first exemplary embodiment of the present invention.

As shown in FIG. 3, when a tail end of the first sheet S1 conveyed in the in-body duplex path 330 exits the in-body feed path 310, the first flapper 360 is moved to swing rearward to the outlet position. Therefore, with regard to the in-body feed path 310, the first exit path 320 is opened to be continuous with the in-body feed path 310, and the inlet of the in-body duplex path 330 is closed.

When the tail end of the first sheet S1 conveyed in the in-body duplex path 330 reaches the diverging point of the second path 332 from the first path 331, the third conveyer roller 344 is rotated in the reverse direction. With the reverse rotation of the third conveyer roller 344, the first sheet S1 is reversed, and the lower end, which has been the tail end, of the first sheet S1 now becomes a leading end. Thus, the first sheet S1 having been turned upside-down is guided in the second path 332 to the image forming unit 4.

Meanwhile, after the lower end of the first sheet S1 exits the in-body feed path 310 and the first flapper 360 is moved to the outlet position, a second sheet S2 is conveyed through the fixing unit 6. The second sheet S2 is guided in the in-body feed path 310 to the first exit path 320, and to the main outlet tray 21 or one of the optional trays 220 in the sheet-exit unit 200.

According to the laser printer 1 described above, when double-face printing is performed with a plurality of sheets S, the first sheet S with an image formed on the first side may be guided in the in-body duplex path 330 to the image forming unit 4 without being conveyed in the first exit path 320. Therefore, the second sheet S may be guided through the first exit path 320 to the main outlet tray 21 or to the optional tray 220 in the sheet-exit unit 200 to be ejected in shorter time without waiting for the first sheet S1 to be ejected out of the main body 2 by the main exit roller 343 and drawn back inside the main body 2. Accordingly, compared to the configuration, in which the first sheet S1 occupies the first exit path 320 to be temporarily ejected out of the main body 2 by the main exit roller 343 and drawn back inside the main body 2 while the second sheet S2 is waiting for the first exit path 320 to be cleared, the interval between the image forming on the first sheet S1 and the image forming on the second sheet S2 may be shortened.

According to the laser printer 1 described above, the sheets S conveyed in the main in-body duplex path 330 through the opening 25 to the outside of the main body 2 are guided to the exit-unit duplex path 290 of the sheet-exit unit 200. Therefore, the sheet S, with which the double-face printing is not completed, may be restricted from being exposed to the outside, and the sheet S in the incomplete printing operation may be prevented from being pulled erroneously out of the laser printer 1 by a user.

According to the laser printer 1 described above, the sheet-exit unit 200 is provided with the exit-unit duplex path 290, separately from the outlet path 240. The additional structure of the exit-unit duplex path 290 may affect to increase a volume of the sheet-exit unit 200. However, while the exit-unit duplex path 290 extends along the outlet path 240, the volume to be increased in the sheet-exit unit 200 may be restrained to a smaller extent.

Figure 4:
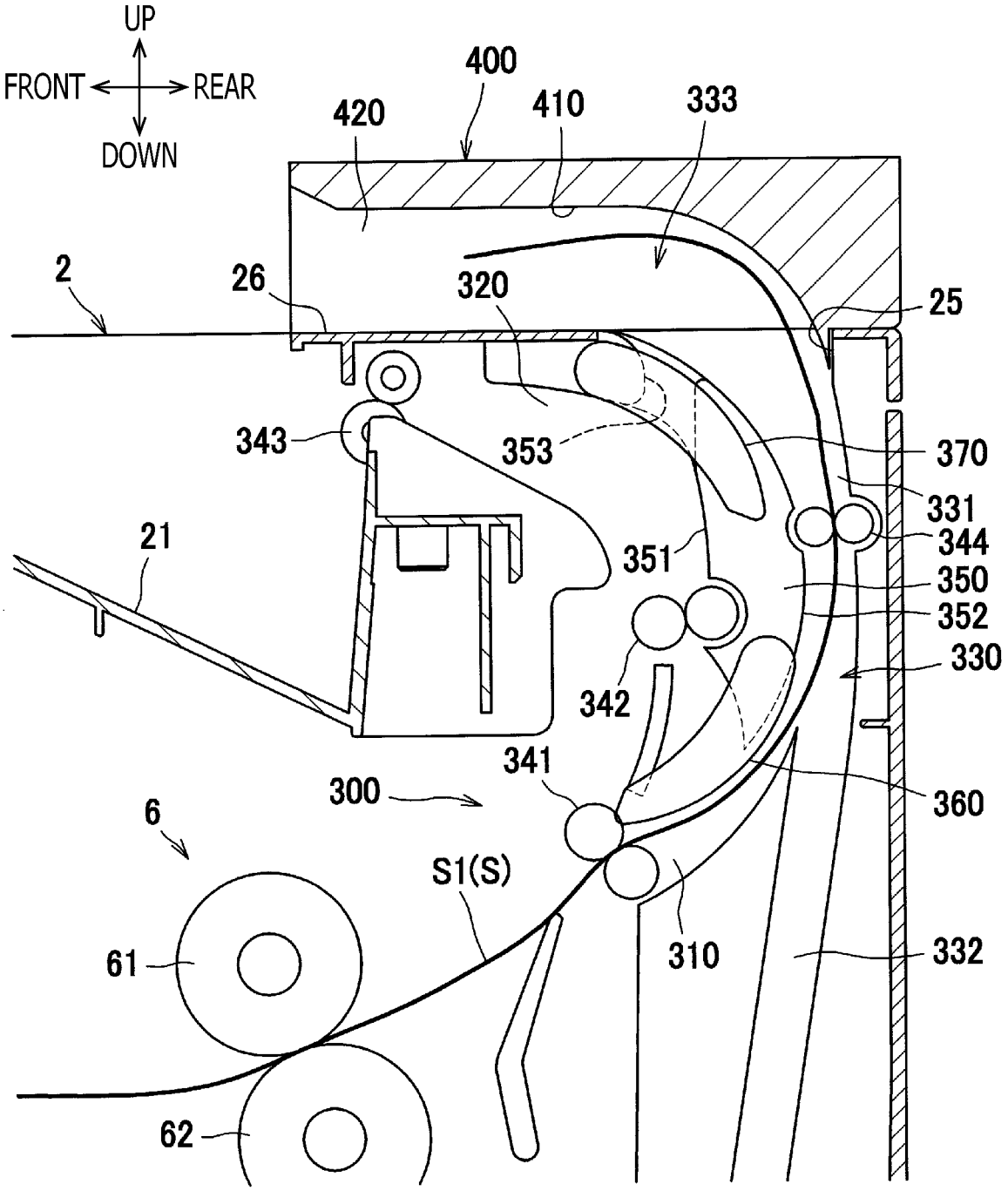
FIG. 4 is a partially enlarged view of the conveyer unit in the laser printer with a cover being attached to a main body, when the sheet is to be conveyed to the duplex path, according to the first exemplary embodiment of the present invention.
Figure 5:
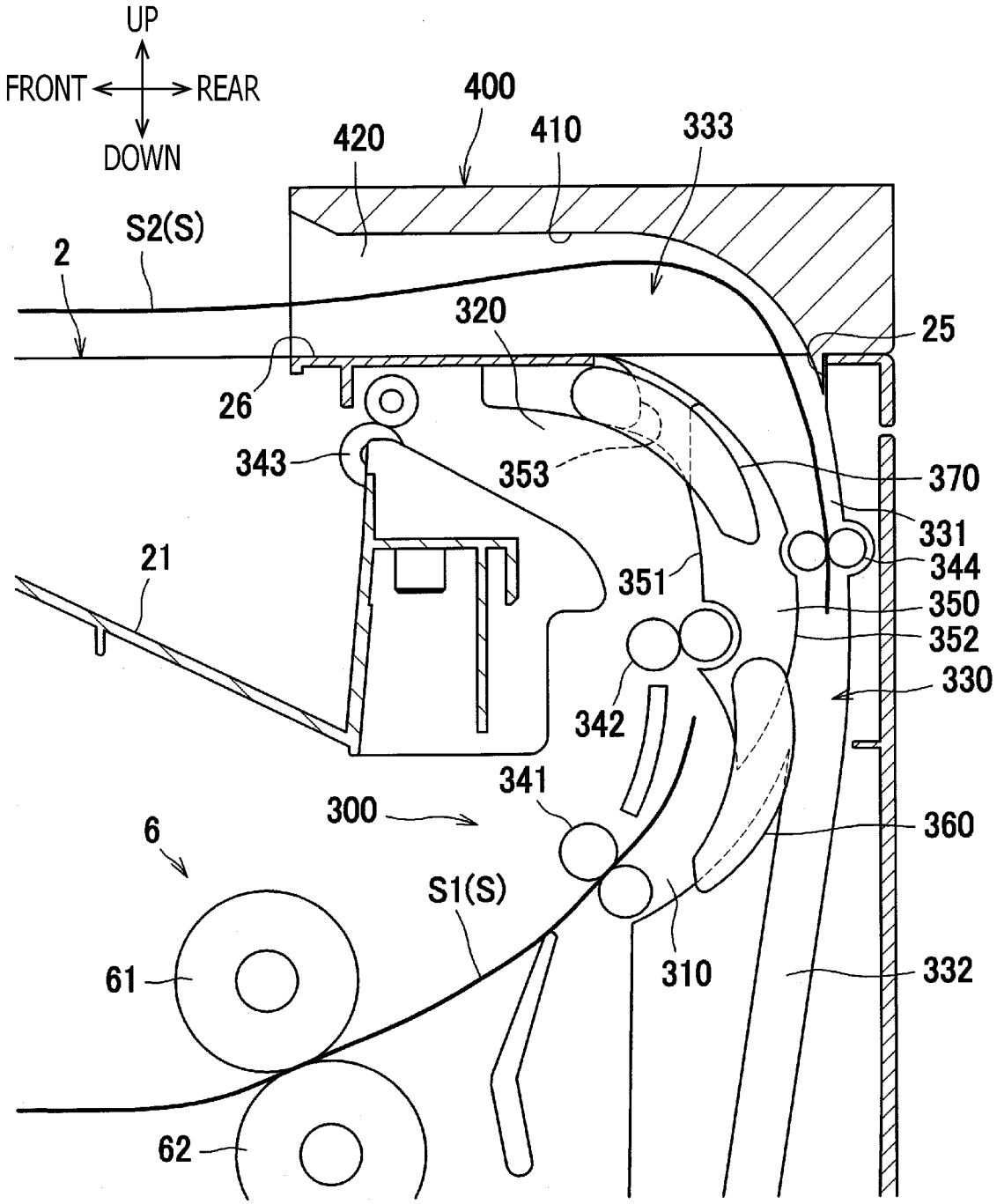
FIG. 5 is a partially enlarged view of the conveyer unit in the laser printer with the cover being attached to the main body, when the succeeding sheet is conveyed to the first exit path, according to the first exemplary embodiment of the present invention.

According to the laser printer 1 described above, when the sheet-exit unit 200 is not attached to the main body 2, the cover 400 may be attached to the main body 2, as shown in FIG. 4. Therefore, while the cover 400 is placed over the opening 25 in the main body 2, the main body 2 may restrain dust in the atmosphere from entering the main body 2 through the opening 25.

When the laser printer 1 performs double-face printing operation with the cover 400 being attached to the main body 2, to start with, the first flapper 360 is moved to swing forward to the returning position. Thereby, the first exit path 320 is closed, and the in-body duplex path 330 is opened. Meanwhile, the second flapper 370 is moved to the first position so that the communication slot 353 is closed and the temporary exit path 333 is formed. In this arrangement, the first sheet S with the image having been formed on the first side thereof is conveyed through the in-body feed path 310 to the temporary exit path 333 in the in-body duplex path 330. Thereafter, the first sheet S1 once conveyed to the temporary exit path 333 is now guided by the guide surface 410 of the cover 400 and conveyed frontward by the third conveyer roller 344 in the normal rotation.

Thereafter, when the tail end (i.e., the lower end) of the first sheet S1 reaches the diverging point between the temporary exit path 333, more specifically, the first path 331, and the second path 332, the third conveyer roller 344 is rotated in the reverse direction. Thereby, the first sheet S1 is conveyed to the second path 332 toward the image forming unit 4 with the lower end now becoming the leading end.

Meanwhile, after the tail end of the first sheet S1 passes through the in-body feed path 310 and the first flapper 360 is moved to the outlet position, the second sheet S2 is conveyed out of the fixing unit 6. The second sheet S2 is guided through the in-body feed path 310 to the first exit path 320 to be ejected out of the main body 2 and placed on the main outlet tray 21.

Thus, even without the sheet-exit unit 200, when the laser printer 1 conducts double-face printing, the succeeding sheet S2 may be conveyed to the first exit path 320 shortly after the preceding sheet S1 with the image formed on the first side thereof is conveyed to the in-body duplex path 330 without traveling through the first exit path 320. Therefore, the interval between the image forming to form the image on the first sheet S1 and the image forming to form the image on the second sheet S2 may be shortened.

Further, the cover 400 provides the guide surface 410 to guide the sheets S to be guided there-along. Therefore, while the opening 25 of the main body 2 is covered by the cover 400 from above, the sheets S may be conveyed smoothly without being interfered with by the cover 400.

Although an example of carrying out the invention has been described, those skilled in the art will appreciate that there are numerous variations and permutations of the laser printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the sheet-exit unit 200 in the laser printer 1 may not necessarily be equipped with the exit-unit duplex path 290, but the laser printer 1 may be in a configuration such that the sheet S conveyed through the in-body feed path 310 to the in-body duplex path 330 may be exposed outside the main body 2 through the opening 25 and drawn again inside the main body 2 with the reverse rotation of the third conveyer roller 344.

Next, a laser printer 1A, as a second exemplary embodiment that may provide the same or similar usability as the laser printer 1 described above, will be described below. In the following example, items or structures which are the same as or similar to the items or the structures described in the previous embodiment will be referred to by the same reference signs, and description of those will be omitted.

Figure 6:
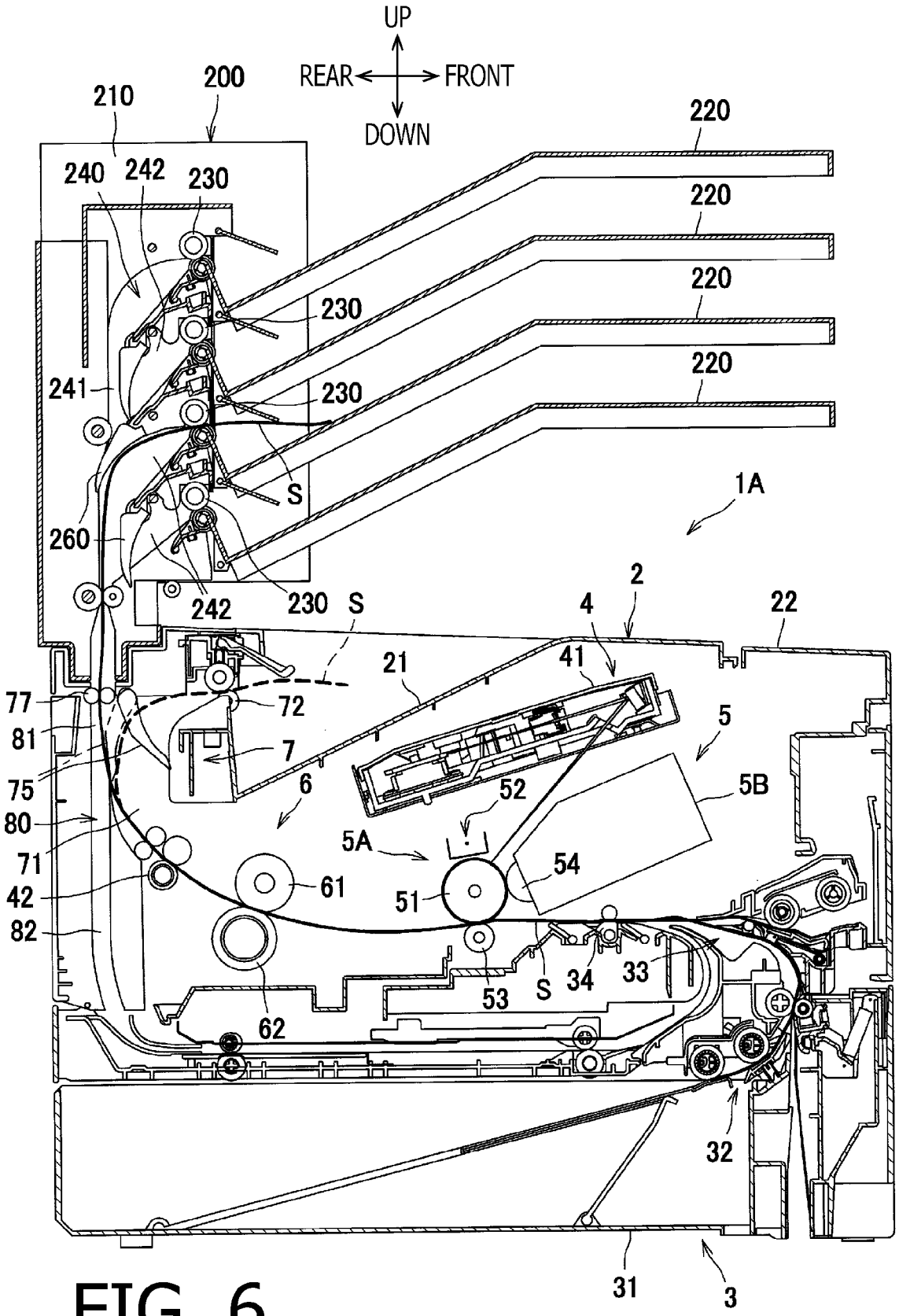
FIG. 6 is an illustrative cross-sectional view of the laser printer with the sheet-exit unit according to a second exemplary embodiment of the present invention.

In the following description, directions concerning the laser printer 1A will be referred to in accordance with a user's ordinary position to use the laser printer 1A, as indicated by arrows in FIGS. 6-13. Therefore, for example, a viewer's right-hand side appearing in FIG. 6 is referred to as a front side of the laser printer 1A, and a left-hand side in FIG. 6 opposite from the front side is referred to as a rear side. A side which corresponds to the viewer's nearer side is referred to as a left-hand side for the user, and an opposite side from the left, which corresponds to the viewer's farther side is referred to as a right-hand side for the user. An up-down direction in FIG. 6 corresponds to a vertical direction of the laser printer 1A. Further, the right-to-left or left-to-right direction of the laser printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 7-13 are similarly based on the orientation of the laser printer 1A as defined above and correspond to those with respect to the laser printer 1A shown in FIG. 6 even when the drawings are viewed from different angles.

The laser printer 1A is capable of forming images on either side or both sides of the sheet S. As shown in FIG. 6, the laser printer 1A includes the main body 2 and is usable along with the sheet-exit unit 200, which is an optional device, attached on top of the main body 2.

The main body 2 includes the feeder unit 3, the image forming unit 4, and a conveyer unit 7. The main body 2 further includes the main outlet tray 21, on which the sheet S with the image formed thereon is placed, in an upper part thereof. The main outlet tray 21 is disposed in the upper position with respect to the image forming unit 4.

The image forming unit 4 may serve to form the image on the sheet S being fed and is disposed in the upper position with respect to the sheet cassette 31. The image forming unit 4 includes the scanner unit 41, the processing cartridge 5, the fixing unit 6, and a curl-remover roller 42.

The curl-remover roller 42 is disposed in a rearward position with respect to the fixing unit 6 and is configured to correct curled deformation of the sheets S having been conveyed through the fixing unit 6.

The conveyer unit 7 may serve to guide the sheet S having been conveyed through the image forming unit 4 to the main outlet tray 21 or to the sheet-exit unit 200. Further, the conveyer unit 7 may serve to guide the sheet S having been conveyed through the image forming unit 4 to return again to the image forming unit 4. Detailed configuration of the conveyer unit 7 will be described later.

The sheet-exit unit 200 includes the plurality of optional trays 220, which are arranged to align vertically. The sheets S conveyed through the main body 2 may be sorted to one or more of the optional trays 220.

Figure 7:
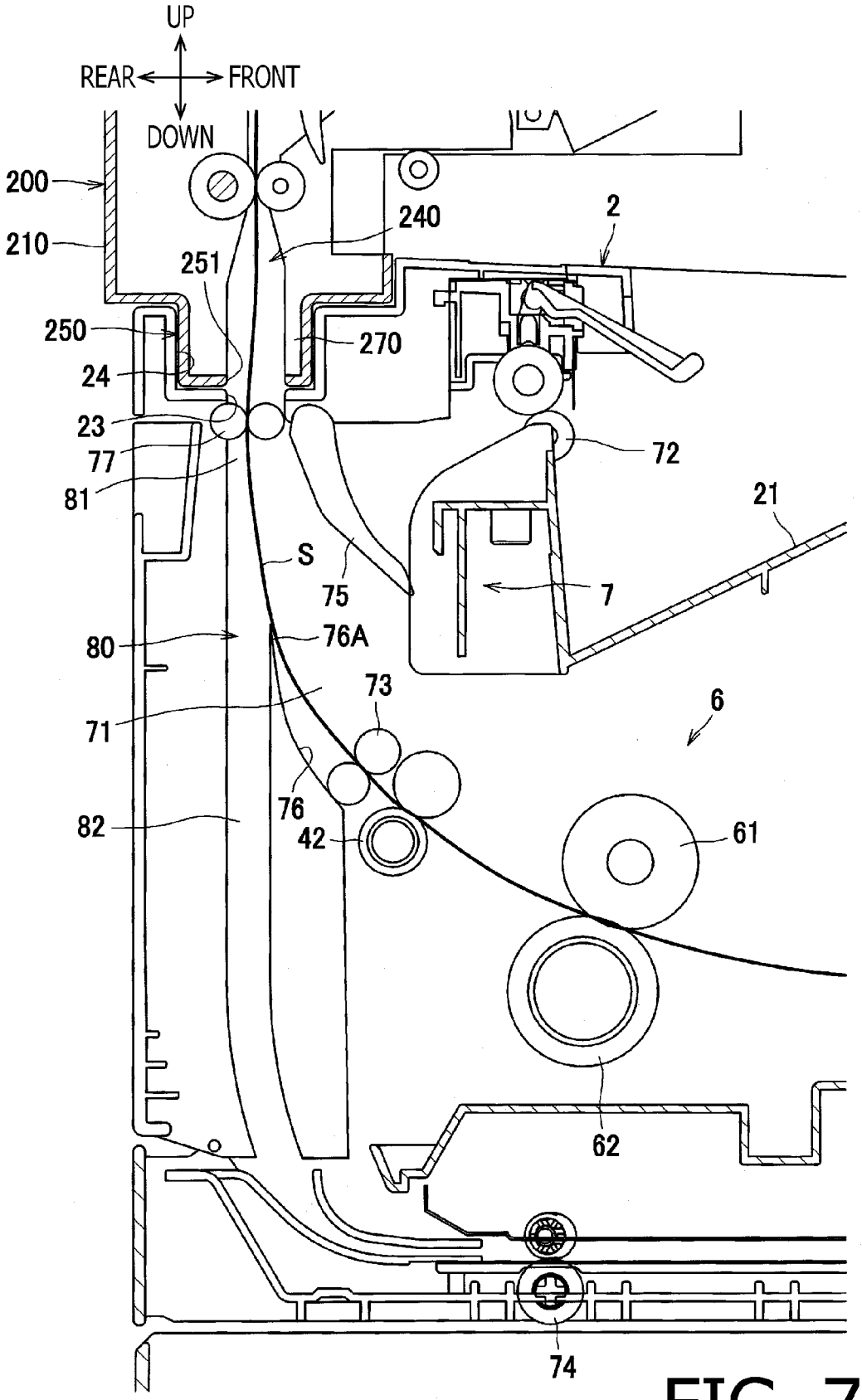
FIG. 7 is a partially enlarged view of an exit path and a duplex path in the laser printer according to the second exemplary embodiment of the present invention.

Next, a configuration of the conveyer unit 7 will be described below. As shown in FIG. 7, the conveyer unit 7 includes an in-body exit path 71, an in-body exit roller 72, an intermediate exit roller 73, a duplex path 80, a plurality of pairs of sheet-conveyer rollers 74 (see FIG. 6), a flapper 75, and an exit roller 77. The sheet-conveyer rollers 74 convey the sheets S in the duplex path 80. The flapper 75 is movable to swing frontward and rearward.

The in-body exit path 71 is a pathway, in which the sheets S having been conveyed through the image forming unit 4 are guided to the main outlet tray 21 to be ejected, and includes a U-turn guide 76.

The U-turn guide 76 forms a rear side of the in-body exit path 71 and includes a guiding surface (unsigned) with curvature. With the curvature of the guiding surface, when the sheet S conveyed by the curl-remover roller 42 rearward to be away from the image forming unit 4 contacts the guiding surface, the sheet S is guided to turn frontward in a shape of a "U" toward the main outlet tray 21.

The in-body exit roller 72 is disposed at an outlet of the in-body exit path 71, that is, between the in-body exit path 71 and the main outlet tray 21. Rotation of the in-body exit roller 72 conveys the sheets S having been through the in-body exit path 71 and guides the sheets S to the main outlet tray 21.

The intermediate exit roller 73 is disposed in a position between the curl-remover roller 42 and the in-body exit roller 72 along the direction to convey the sheets S in the in-body exit path 71.

The duplex path 80 diverges from the in-body exit path 71 and provides a pathway to guide the sheets S to return to the image forming unit 4. The duplex path 80 includes a first path 81, which diverges from the in-body exit path 71 and extends to provide a passage to the outside of the main body 2, and a second path 82, which diverges from the first path 81 and extends toward the image forming unit 4.

The main body 2 includes an on-body communication slot 23 and a receptacle part 24 in rearward positions on an upper surface thereof. The receptacle part 24 is formed to dent downward from the upper surface of the main body 2, and the on-body communication slot 23 is formed at a bottom of the dent. The on-body communication slot 23 is formed in a rearward position with respect to the in-body exit path 71 to allow the sheets S to pass there-through.

The first path 81 diverges from a bottom 76A of the U-shape of the U-turn guide 76 in the in-body exit path 71 to extend upward and is continuous with the on-body communication slot 23. In the present example, the bottom 76A of the U-turn guide 76 refers to the farthest part of the guiding surface of the U-turn guide 76 from the image forming unit 4 with regard to the front-rear direction, i.e., a part which is located at a rearmost position in the U-turn guide 76.

Thus, with the first path 81 diverged from the bottom 76A of the U-turn guide 76, it is not necessary that the first path 81 is formed to curve rearward to avoid the U-turn guide 76, but the first path 81 may be formed to extend straight toward the on-body communication slot 23. Accordingly, the main body 2 may be effectively downsized.

The second path 82 is formed to diverge from the first path 81 vertically downward to extend through a rear side of the U-turn guide 76. Further, the second path 82 is formed to curve frontward to extend through a position between the image forming unit 4 and the sheet cassette 31, and to merge with the feeder path 33 at a frontward position with respect to the paired registration rollers 34 (see FIG. 6).

Thus, with the second path 82 formed to extend vertically downward from the first path 81, the main body 2 may be downsized compared to a configuration, in which the second path is formed to curve rearward.

The exit roller 77 is disposed along the first path 81 in a lower position with respect to the on-body communication slot 23. The exit roller 77 is rotatable either in the normal or reverse direction. The exit roller 77 being rotated in the normal direction may convey the sheets S being guided in the first path 81 outward through the on-body communication slot 23 outside the main body 2, and the exit roller 77 being rotated in the reverse direction may convey the sheets S inward to draw inside the main body 2.

The flapper 75 may serve to switch the directions to convey the sheets S at a diverging point between the in-body exit path 71 and the duplex path 80, more specifically, the first path 81. The flapper 75 is disposed in a position downstream from the curl-remover roller 42 with regard to the direction to feed the sheets S in the in-body exit path 71, for example, in a position between the intermediate exit roller 73 and the in-body exit roller 72.

The flapper 75 is swingable with respect to the main body 2 with an upper end thereof being swingably attached to an upper wall of the main body 2 so that a lower end of the flapper 75 may swing frontward and rearward. The flapper 75 is moved to swing rearward to be placed in a first position, as indicated by double-dotted lines in FIG. 6, when the sheet S having been conveyed through the image forming unit 4 is to be guided to the tray 21. When the sheet S having been conveyed through the image forming unit 4 is to be guided to the duplex path 80, the flapper 75 is moved to swing frontward to be placed in a second position, as indicated by solid lines in FIG. 6.

Along with the conveyer unit 7 configured as above, when the sheet-exit unit 200 is attached to the main body 2, as shown in FIG. 7, the outlet path 240 is connected with the duplex path 80.

A chassis 210 of the sheet-exit unit 200 has an engageable part 250, which is formed to protrude from a bottom of the chassis 210, and the engageable part 250 may be fitted in the receptacle part 24 in the main body 2. The engageable part 250 forms a lower end of an exit-unit guide 270, which forms a part of the outlet path 240. The engageable part 250 is formed to have an on-ejector communication slot 251, which is continuous with the outlet path 240 on a bottom thereof.

Therefore, when the sheet-exit unit 200 is attached to the main body 2, with the engageable part 250 being fitted in the receptacle part 24, the on-ejector communication slot 251 aligns with the on-body communication slot 23 vertically.

Thus, with the outlet path 240 being connected with the duplex path 80, the main body 2 may restrain dust in the atmosphere from entering the duplex path 80 through the on-body communication slot 23.

In the present embodiment, a distance between the diverging point, where the first path 81, or the duplex path 80, diverges from the in-body exit path 71, and one of the outlet rollers 230 located at an uppermost position in the first outlet path 241 is longer than a length of the sheet S along the direction to convey the sheet S.

Figure 8:
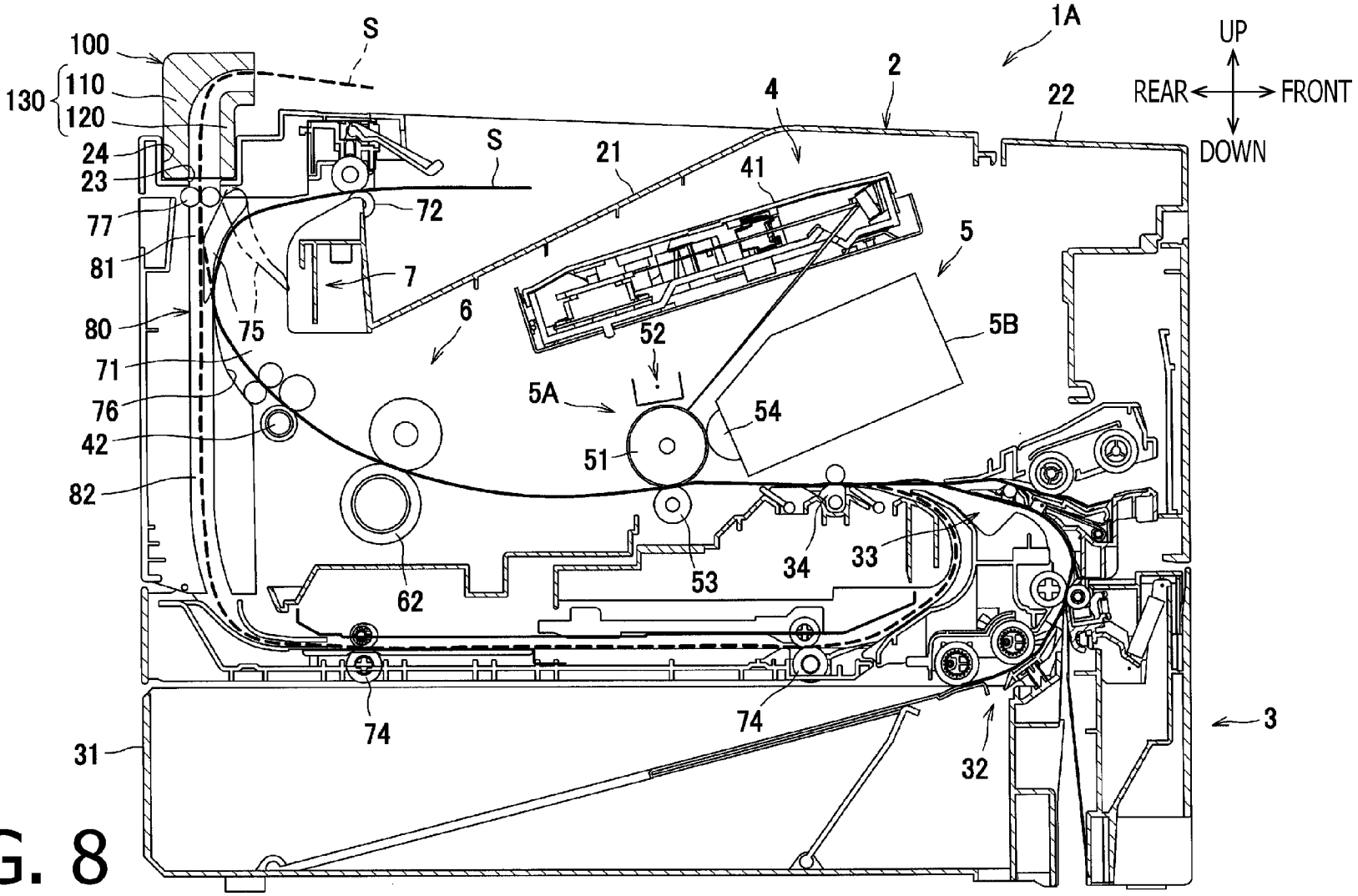
FIG. 8 is a cross-sectional view of the laser printer with a cover according to the second exemplary embodiment of the present invention.

Meanwhile, as shown in FIG. 8, the laser printer 1A includes a cover 100, which is detachably attached to the main body 2 when the sheet-exit unit 200 is not attached to the main body 2. The cover 100 attached to the main body 2 may be placed over the on-body communication slot 23. Further, the cover 100 may guide the sheets S being conveyed through the on-body communication slot 23.

The cover 100 may be a sleeve member formed to have a cross-sectional shape of an "L" and may be fitted in the receptacle part 24 at one end thereof. The cover 100 includes a first guide part 110, which extends from a rear side of the on-body communication slot 23 upward and bends frontward beyond the on-body communication slot 23, when the cover 100 is attached to the main body 2. Further, the cover 100 includes a second guide part 120, which extends from a front side of the on-body communication slot 23 upward and bends frontward to face with the first guide part 110. The first guide part 110 and the second guide part 120 form an in-cover guide 130, which guides the sheets S ejected through the on-body communication slot 23 frontward, i.e., in a direction along the upper surface of the main body 2. While the cover 100 is attached to the main body 2, the first guide part 110 and the second guide part 120 are at least partly fitted in the receptacle part 24.

Next, behaviors of the laser printer 1A will be described below. When the sheet S with the image formed thereon and having been conveyed through the image forming unit 4 is guided to a designated one of the optional trays 220 in the sheet-exit unit 200, the flapper 75 is moved to swing frontward to the second position so that the first path 81 is opened and a part of the in-body exit path 71 downstream from the diverging point between the first path 81 and the in-body exit path 71 with regard to the direction to feed the sheet S is closed. With the flapper 75 in the second position, when the sheet S is conveyed through the image forming unit 4, the sheet S is guided in the in-body exit path 71 to the first path 81. Further, the sheet S in the first path 81 is conveyed by the exit roller 77 through the on-body communication slot 23 and the on-ejector communication slot 251 to the outlet path 240 in the sheet-exit unit 200.

Meanwhile, the switching members 260 are moved to swing in the sheet-exit unit 200 so that the second outlet path 242 continuous with the designated optional tray 220 is opened. Thereby, the sheet S conveyed through the outlet path 240 is guided to the designated optional tray 220 and ejected by the outlet rollers 230 on the designated optional tray 220.

Figure 9:
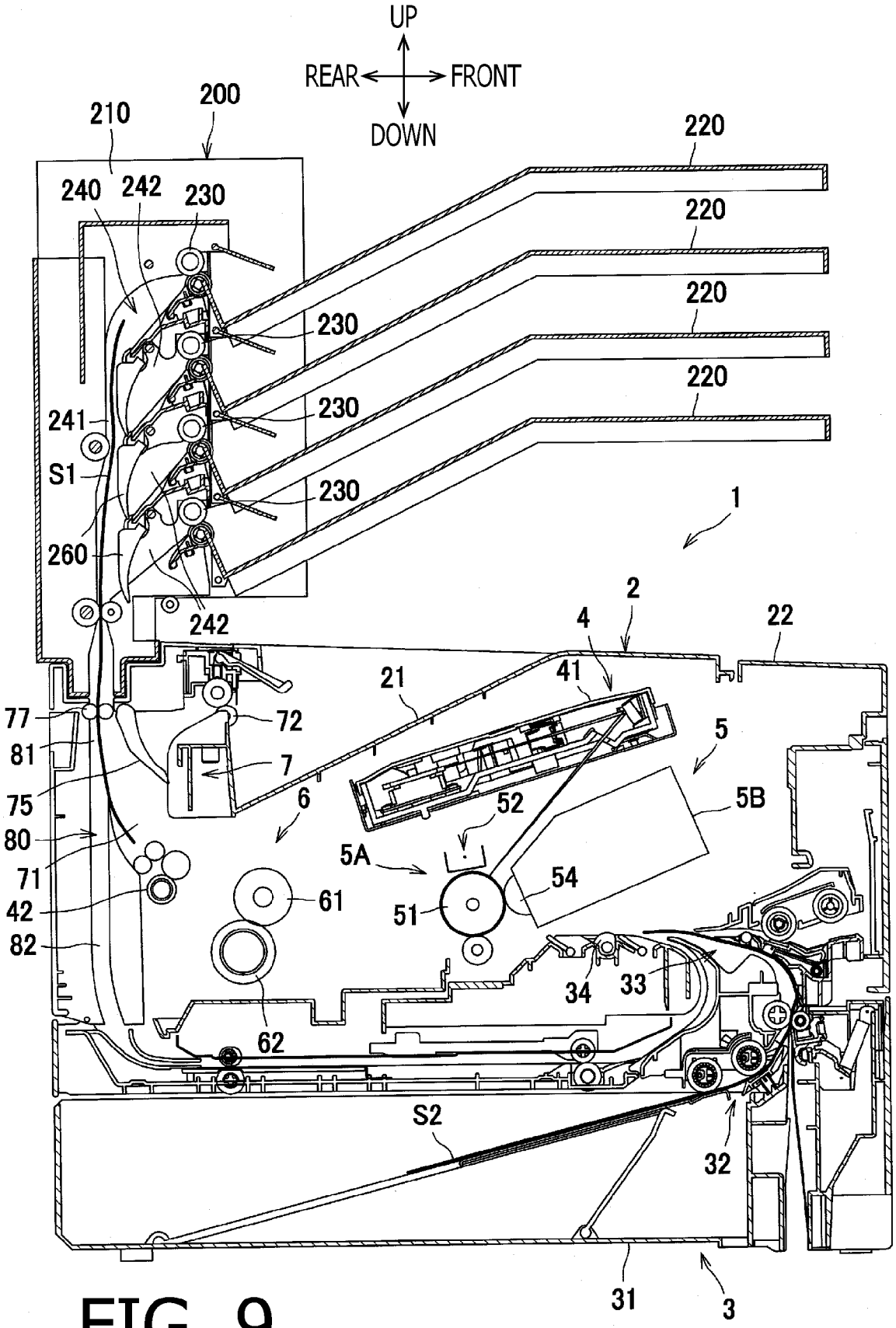
FIG. 9 is a cross-sectional view of the laser printer, when a first sheet is being conveyed to an outlet path in the sheet-exit unit during a double-face printing operation, according to the second exemplary embodiment of the present invention.

When double-face printing is to be performed to form images on each side of a plurality of sheet S1, S2, while the sheet-exit unit 200 is attached to the main body 2, as shown in FIG. 9, the flapper 75 is moved to swing frontward to the second position. Thus, the first path 81 is opened, and the downstream part of the in-body exit path 71 from the diverging point between the first path 81 and the in-body exit path 71 with regard to the direction to feed the sheet S is closed. The first sheet S1 with an image formed on the first side thereof is conveyed through the image forming unit 4 and guided to the in-body exit path 71 and to the first path 81. Thereafter, the first sheet S1 in the first path 81 is conveyed by the exit roller 77 rotating in the normal direction through the on-body communication slot 251 to the outlet path 240 in the sheet-exit unit 200.

When the tail end of the first sheet S1 conveyed in the outlet path 240 exits the in-body exit path 71, the exit roller 77 is rotated in the reverse direction. With the reverse rotation of the exit roller 77, the first sheet S1 is reversed, and the lower end, which has been the tail end, of the first sheet S1 now becomes the leading end. Thus, the first sheet S1 having been turned upside-down is guided in the second path 82 to the image forming unit 4.

Figure 10:
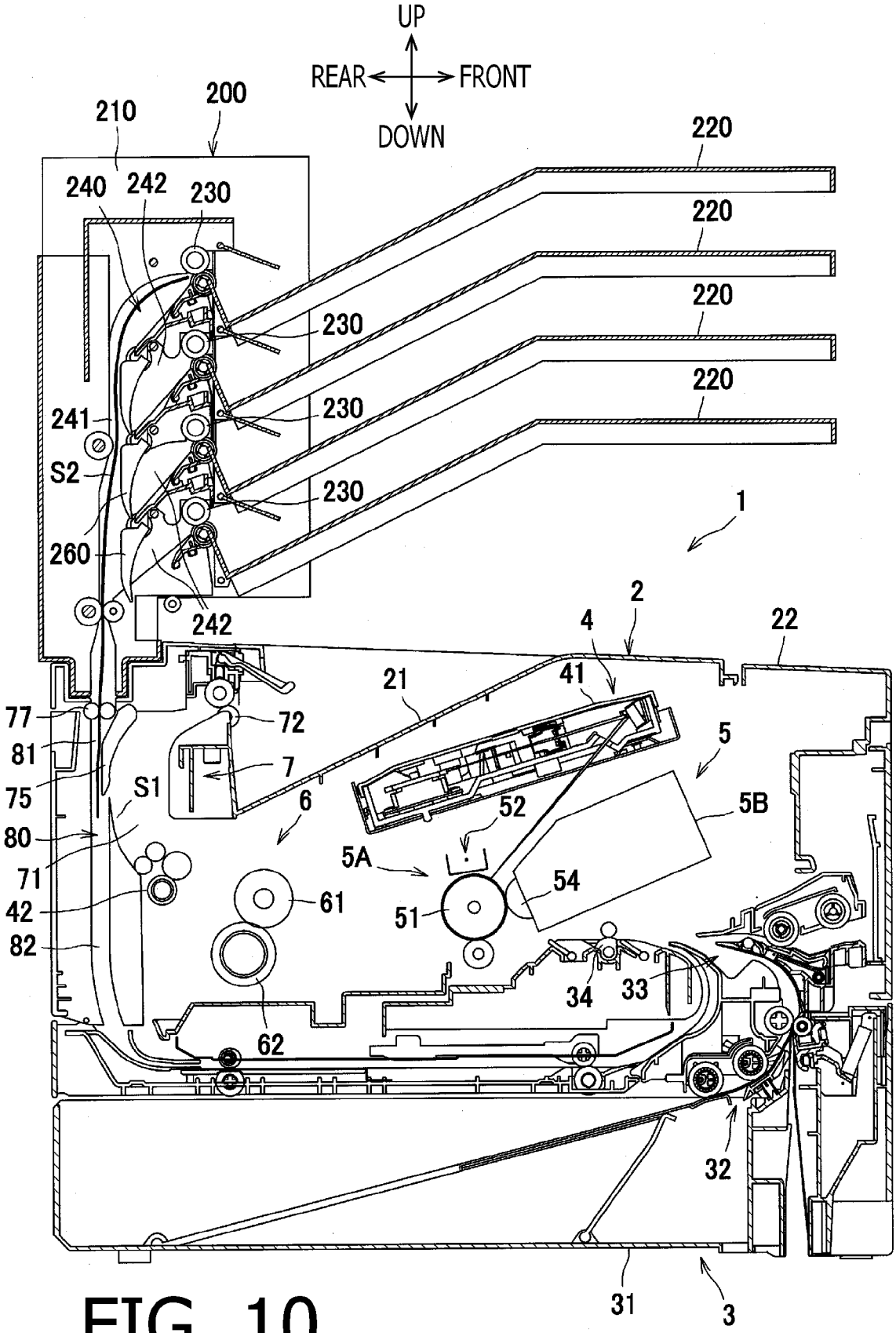
FIG. 10 is a cross-sectional view of the laser printer, when a second sheet is conveyed to the outlet path during the double-face printing operation, according to the second exemplary embodiment of the present invention.

Meanwhile, as the first sheet S1 is guided in the duplex path 80 and the outlet path 240, the second sheet S1 is fed from the feeder unit 3 to the image forming unit 4 so that the image is formed on a first side of the second sheet S1. The second sheet S2 is guided to exit the image forming unit 4 before the first sheet S1 conveyed through the second path 82 reaches the image forming unit 4. Thereafter, as shown in FIG. 10, the second sheet S2 is conveyed through the in-body exit path 71 and the first path 81 to the outlet path 240 in the sheet-exit unit 200, similarly to the first sheet S1.

When the tail end of the second sheet S2 exits the in-body exit path 71, the flapper 75 is moved to swing rearward to the first position. Thus, the downstream part of the in-body exit path 71 with regard to the diverging point between the first path 81 and the in-body exit path 71 is opened, and the first path 81 is closed. Therefore, the first sheet S1 with the images formed on both sides thereof following the second sheet S2 may be ejected through the in-body exit path 71 to be placed in the main outlet tray 21.

Thus, while the first sheet S1 is ejected to the main outlet tray 21, the exit roller 77 may be rotated in the reverse direction so that the second sheet S2 conveyed to the outlet path 240 may be guided to the second path 82 with the lower end, i.e., the former tail end, becoming the leading end, to the image forming unit 4. Thereafter, the second sheet S2 having been conveyed through the image forming unit 4 with the images formed on the both sides thereof may be guided through the in-body exit path 71 to be ejected to the main outlet tray 21.

According to the laser printer 1A described above, when double-face printing is performed with a plurality of sheets S1, S2, the first sheet S1 with an image formed on the first side may be conveyed temporarily to the sheet-exit unit 200 and thereafter to the image forming unit 4 without being conveyed by the in-body exit roller 72. Therefore, the second sheet S may be guided to the main outlet tray 21 shortly after the first sheet S reaches the sheet-exit unit 200. Accordingly, compared to the configuration, in which the first sheet is ejected out of the main body 2 by the in-body exit roller 72 and drawn back inside the main body 2 while the second sheet S2 is waiting for the in-body exit roller 72 to release the first sheet S1, the interval between the image forming on the first sheet S1 and the image forming on the second sheet S2 may be shortened.

If, for example, the laser printer 1A was configured such that the sheet S is temporarily ejected out of the main body 2 by the in-body exit roller 72 and drawn back inside the main body 2 to have the image formed on the second side of the sheet S, the sheet S, with which the double-face printing is not completed, may be exposed, and the user may erroneously pull the incomplete sheet S out of the main body 2. According to the present example, however, the distance between the diverging point, where the first path 81, or the duplex path 80, diverges from the in-body exit path 71, and one of the outlet rollers 230 located at the uppermost position in the first outlet path 241 is longer than the length of the sheet S along the direction of conveying the sheet S. Therefore, the sheet S, with which the double-face printing is not completed, may be restricted from being exposed to the outside, and the sheet S in the incomplete printing operation may be prevented from being pulled erroneously out of the laser printer 1 by the user.

According to the laser printer 1A described above, when the sheet-exit unit 200 is not attached to the main body 2, the cover 100 may be attached to the main body 2, as shown in FIG. 8. Therefore, while the cover 100 is placed over the on-body communication slot 23, the main body 2 may restrain dust in the atmosphere from entering the main body 2 through the on-body communication slot 23.

When the laser printer 1A performs a double-face printing operation with the cover 100 being attached to the main body 2, the flapper 75 is moved to swing frontward so that the first path 81 is opened, and the downstream part of the in-body exit path 71 with regard to the diverging point between the first path 81 and the in-body exit path 71 is closed. Therefore, the first sheet S1 with the image formed on the first side thereof is guided through the in-body exit path 71 to the first path 81. Thereafter, the first sheet S1 guided through the first path 81 is conveyed by the exit roller 77 rotating in the normal direction out of the main body 2 through the on-body communication slot 23. The sheet S conveyed out of the main body 2 through the on-body communication slot 23 is guided by the in-cover guide 130 to be conveyed frontward.

Thereafter, when the tail end of the sheet S1 exits the in-body exit path 71, the exit roller 77 is rotated in the reverse direction. With the reverse rotation of the exit roller 77, the sheet S1 is reversed, and the lower end, which has been the tail end, of the first sheet S1 now becomes a leading end. Thus, the first sheet S1 having been turned upside-down is guided in the second path 82 to the image forming unit 4.

Thus, even without the sheet-exit unit 200, when the laser printer 1A conducts double-face printing, the sheet S with the image formed on the first side thereof may be reversed and guided to the image forming unit 4 without being conveyed by the in-body exit roller 72. Therefore, the interval between the image forming to form the image on the preceding sheet S1 and the image forming to form the image on the succeeding sheet S2 may be shortened.

Further, the cover 100 provides the in-cover guide 130 to guide the sheets S to be conveyed there-along. Therefore, while the on-body communication slot 23 of the main body 2 is covered by the cover 100 from above, the sheets S may be conveyed smoothly without being interfered with by the cover 100.

According to the embodiment described above, the in-cover guide 130 in the cover 100 and the exit-unit guide 270 may be fitted in the receptacle part 24 in the main body 2 so that the in-cover guide 130 and the exit-unit guide 270 connected with the duplex path 80 at the same position, i.e., the on-body communication slot 23. Therefore, compared to a configuration, in which the in-cover guide 130 and the exit-unit guide 270 are connected with the duplex path 80 at different positions, the connection may be established in a less complex structure.

Figure 11:
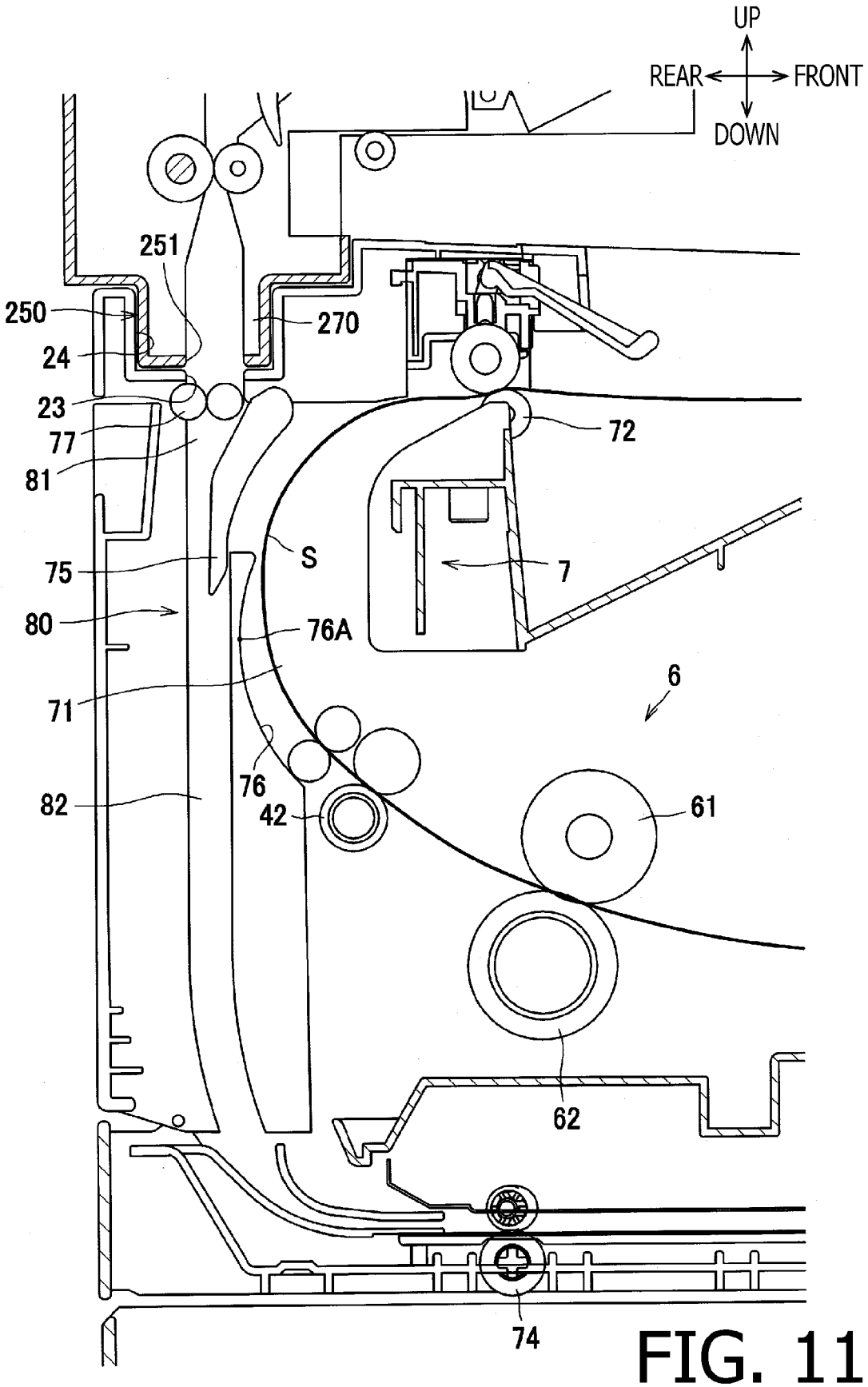
FIG. 11 is a cross-sectional view of the laser printer with the exit path and the duplex path according to a first modified example of the second exemplary embodiment of the present invention.

According to the example described above, the duplex path 80, more specifically, the first path 81, is arranged to diverge from the in-body exit path 71 at the bottom 76A of the U-turn guide 76. However, for example, as shown in FIG. 11, the duplex path 80 may be arranged to diverge from the in-body exit path 71 at a position closer to the main outlet tray 21 than the bottom 76A of the U-turn guide 76. Even in this arrangement, as well as the duplex path 80 described in the above example, it is not necessary that the first path 81 is formed to curve rearward to avoid the bottom 76A of the U-turn guide 76, but the first path 81 may be formed to extend straight toward the on-body communication slot 23. Accordingly, the main body 2 may be effectively downsized.

For another example, the duplex path may be arranged to diverge from the main exit path at a position closer to the curl-remover roller 42 than the bottom of the U-turn guide.

Figure 12:
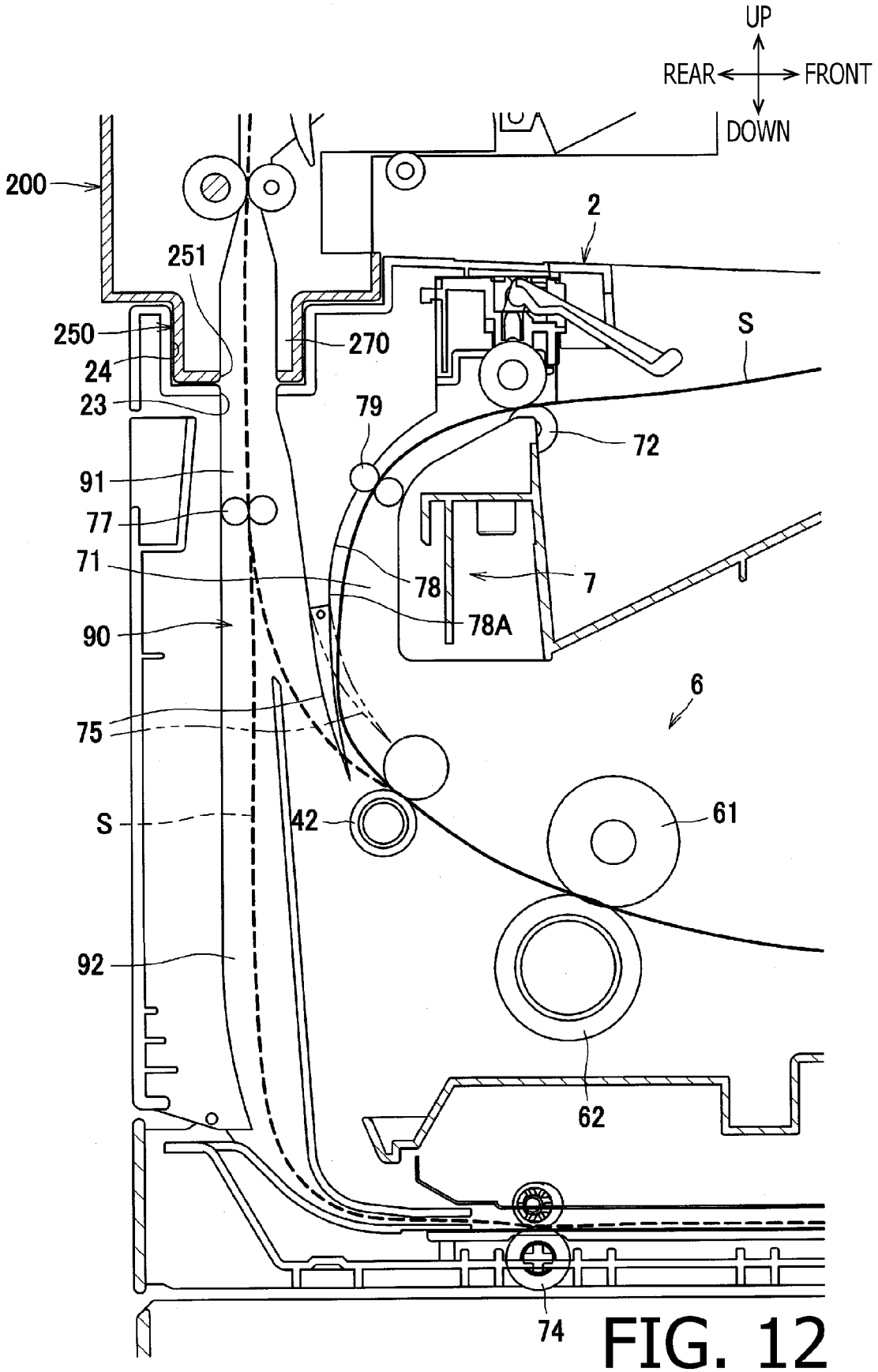
FIG. 12 is a cross-sectional view of the laser printer with the exit path and the duplex path according to a second modified example of the second exemplary embodiment of the present invention.
Figure 13:
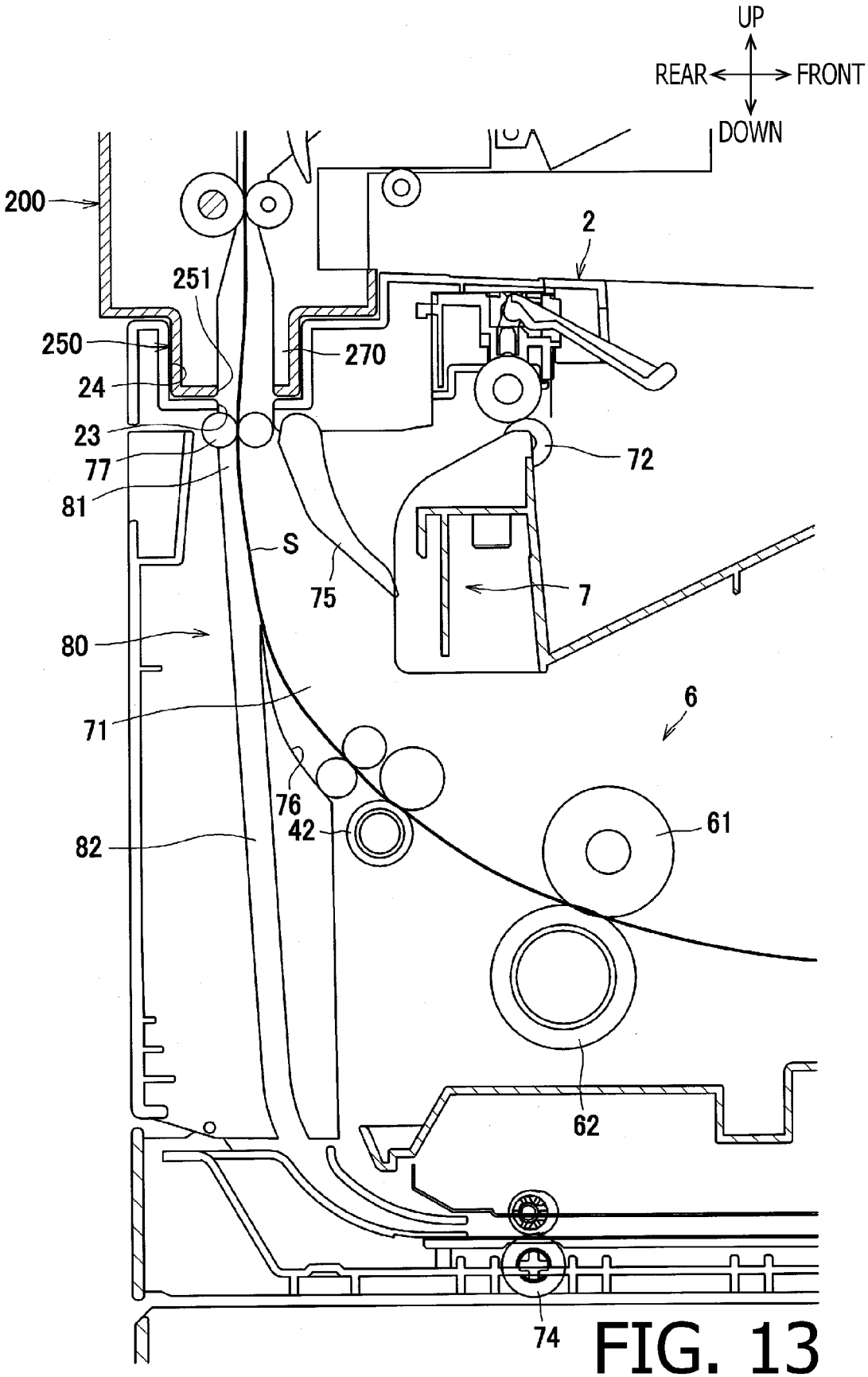
FIG. 13 is a cross-sectional view of the laser printer with the exit path and the duplex path according to a third modified example of the second exemplary embodiment of the present invention.

More specifically, as shown in FIG. 12, the U-turn guide 78 may have a guide surface, which stretches upper-frontward from an upper-rearward position with respect to the curl-remover roller 42. Meanwhile, on a lower end of the U-turn guide 78, a flapper 78 to switch the directions to convey the sheets S is swingably supported by the U-turn guide 78 to swing frontward and rearward. The flapper 75 is disposed at a position in the vicinity of the curl-remover roller 42. When the flapper 75 is in a rearward position, the sheet S being conveyed through the curl-remover roller 42 is guided by the flapper 75 to the in-body exit path 71. When the flapper 75 is in a frontward position, the sheet S being conveyed through the curl-remover roller 42 is guided to the duplex path 90.

The duplex path 90 may include a first path 91, which diverges from the in-body exit path 71 and extends upward through a rear side of the U-turn guide 78, and a second path 92, which diverges from the first path 91 and extends straight downward.

According to this example, the intermediate exit roller 79 may be disposed downstream from the flapper 75 with regard to the direction to feed the sheets S in the in-body exit path 71. In other words, the flapper 75 may be disposed in a position between the curl-remover roller 42 and the intermediate exit roller 79 along the direction to convey the sheets S.

The second path 82 described in the above example may not necessarily be arranged to extend straight downward from the first path 81 but may be arranged to extend downward and incline frontward from the first path 81 toward the image forming unit 4. In this arrangement of the second path 82, similarly to the previous example, the main body 2 may be downsized compared to the configuration, in which the second path is formed to curve rearward.

What is claimed is:

1. An image forming apparatus, comprising:

a main body comprising a first sheet outlet tray and an image forming unit; and a feed path configured to guide a sheet from the image forming unit toward the sheet outlet tray, the feed path comprising:

a first exit path configured to guide a sheet toward the first sheet outlet tray; and a first duplex path configured to diverge from the feed path and guide a sheet to return to the image forming unit, wherein the main body is configured to be attachable with a sheet-exit unit, the sheet-exit unit comprising a second sheet outlet tray, a second exit path, and a second duplex path, the second exit path being configured to guide a sheet to the second sheet outlet tray;

wherein the second exit path is connected with the first exit path and the second duplex path is connected with the first duplex path when the sheet-exit unit is attached to the main body;

wherein the first sheet outlet tray is disposed in an upper position with respect to the image forming unit;

wherein the first exit path is formed to extend to be away from the image forming unit and turn in a U-shape toward the first sheet outlet tray; and wherein the second exit path is connected with the feed path at a position downstream from a bottom part of the U-shape in the feed path with regard to a direction to feed the sheet when the sheet-exit unit is attached to the main body.

2. The image forming apparatus according to claim 1, wherein the second duplex path is formed to extend along the second exit path when the sheet-exit unit is attached to the main body.

3. The image forming apparatus according to claim 1, further comprising:

a guide comprising a guiding face, the guiding face forming a part of the first exit path at an outer side of the U-shape in the feed path, the guide comprising a slot disposed at a position where the second exit path is connected with the first exit path, when the sheet-exit unit is attached to the main body; and a flapper configured to guide a sheet and to move between a first position, in which the flapper covers the slot, and a second position, in which the flapper does not cover the slot.

4. The image forming apparatus according to claim 3, wherein the first duplex path comprises a temporary exit path when the sheet-exit unit is not attached to the main body, the temporary exit path being formed to extend from the feed path outward with respect to the U-shape in the feed path and to turn in another U-shape toward the first sheet outlet tray; and wherein the second duplex path is connected with the temporary exit path at a position downstream from the slot with regard to the direction to feed the sheet.

5. The image forming apparatus according to claim 4, wherein the flapper in the first position is configured to guide a sheet fed in the first exit path toward the first sheet outlet tray, and the flapper in the second position is configured to guide a sheet fed in the first exit path toward the slot; and wherein the flapper in the first position forms a part of the temporary exit path when the sheet-exit unit is not attached to the main body.

6. The image forming apparatus according to claim 1, wherein the image forming unit comprises a fixing unit and a curl-remover roller, the curl-remover roller being configured to correct curled deformation of a sheet; and wherein the image forming apparatus further comprises a flapper, the flapper being disposed in a position downstream from the curl-remover roller with regard to a direction to feed the sheet in the first exit path, the flapper being configured to switch the direction to feed a sheet at a diverging point where the first duplex path diverges from the feed path.

7. The image forming apparatus according to claim 6, further comprising:

an exit roller disposed between the first exit path and the first sheet outlet tray; and an intermediate exit roller disposed between the curl-remover roller and the exit roller with regard to the direction to feed a sheet, wherein the flapper is disposed between the curl-remover roller and the intermediate exit roller with regard to the direction to feed a sheet.

* * * * *